US010287859B2

(12) United States Patent
Preston et al.

(10) Patent No.: US 10,287,859 B2
(45) Date of Patent: May 14, 2019

(54) APPARATUS AND METHOD FOR DISCONNECTING MALE AND FEMALE CONNECTORS

(71) Applicant: BALLTEC LIMITED, Morecambe, Lancashire (GB)

(72) Inventors: Scott Preston, Morecambe (GB); Marco Teixeira, Morecambe (GB); Jonathan Jackson, Morecambe (GB)

(73) Assignee: BALLTEC LIMITED, Morecambe, Lancashire (GB)

( * ) Notice: Subject to any disclaimer, the term of this patent is extended or adjusted under 35 U.S.C. 154(b) by 0 days.

(21) Appl. No.: 15/037,986

(22) PCT Filed: Dec. 4, 2014

(86) PCT No.: PCT/GB2014/053612

§ 371 (c)(1),
(2) Date: May 19, 2016

(87) PCT Pub. No.: WO2015/082930

PCT Pub. Date: Jun. 11, 2015

(65) Prior Publication Data

US 2016/0290108 A1 Oct. 6, 2016

(30) Foreign Application Priority Data

Dec. 4, 2013 (GB) ..... 1321416.8

(51) Int. Cl.
*E21B 43/01* (2006.01)
*E21B 17/08* (2006.01)
(Continued)

(52) U.S. Cl.
CPC ..... *E21B 43/0107* (2013.01); *E21B 17/017* (2013.01); *E21B 17/085* (2013.01); *E21B 19/004* (2013.01)

(58) Field of Classification Search
CPC ... E21B 17/085; E21B 33/038; E21B 43/0107
See application file for complete search history.

(56) References Cited

U.S. PATENT DOCUMENTS 2,409,811 A * 10/1946 Taylor, Jr. ..... E21B 23/06 166/125
2,665,928 A * 1/1954 Omon ..... F16L 37/23 137/614.04

(Continued)

FOREIGN PATENT DOCUMENTS

GB 2080902 A 2/1982
GB 2424684 A 10/2006

(Continued)

*Primary Examiner* — Matthew R Buck
*Assistant Examiner* — Aaron L Lembo
(74) *Attorney, Agent, or Firm* — Schwabe Williamson & Wyatt, PC

(57) ABSTRACT

A male connector (3) to be inserted into a female connector (5). The male connector defines a conduit and comprises a locking means (39) operable to engage the female connector to thereby lock the male connector relative to the female connector. The male connector also comprises a release means (17) for unlocking the male connector to permit the male connector to be separated from the female connector. The release means is accessible from within the conduit. There may be a release tool (50) operable to disengage the male connector from the female connector and retain the male connector after the male connector has been disengaged from the female connector.

22 Claims, 10 Drawing Sheets

(51) Int. Cl.
*E21B 19/00* (2006.01)
*E21B 17/01* (2006.01)

(56) References Cited

U.S. PATENT DOCUMENTS 3,539,205 A * 11/1970 Johnson, Jr. ..... B29C 57/045 285/260
3,948,545 A * 4/1976 Bonds ..... E21B 17/085 285/39
4,307,902 A 12/1981 Schnatzmeyer
4,399,877 A * 8/1983 Jackson ..... E21B 7/046 166/65.1
4,664,148 A * 5/1987 Magnuson ..... F16L 37/23 137/614.05
4,787,557 A * 11/1988 Jackson ..... B05B 15/062 239/200
4,808,034 A * 2/1989 Birch ..... B63B 27/24 166/367
5,437,518 A 8/1995 Maloberti et al.
5,947,642 A * 9/1999 Teixeira ..... E21B 19/004 166/340
6,155,193 A * 12/2000 Syvertsen ..... B67D 9/00 114/230.12
6,536,527 B2 * 3/2003 Munk ..... E21B 43/0107 166/341
6,558,084 B2 * 5/2003 Moog ..... E21B 19/004 114/230.3
7,204,972 B2 * 4/2007 Tait ..... A61K 51/088 424/1.69
7,373,986 B2 * 5/2008 Pollack ..... E21B 43/0107 166/345
7,938,456 B2 * 5/2011 Chambaud ..... F16L 37/23 285/1
8,016,520 B2 * 9/2011 Dybvik ..... B63B 21/50 114/293
8,550,171 B2 * 10/2013 Wajnikonis ..... E21B 17/015 166/346
8,689,882 B2 * 4/2014 Wajnikonis ..... E21B 17/015 166/343
8,939,214 B2 * 1/2015 Litherland ..... E21B 17/015 166/343
9,267,336 B2 * 2/2016 Routeau ..... E21B 43/0107
9,482,061 B2 * 11/2016 Latimer ..... E21B 17/017
2005/0095198 A1 * 5/2005 Tait ..... A61K 51/088 424/1.69
2006/0269360 A1 11/2006 Rowley
2009/0020061 A1 * 1/2009 Dybvik ..... B63B 21/50 114/230.28
2012/0168172 A1 7/2012 Litherland et al.
2013/0146278 A1 6/2013 Yajure
2014/0145430 A1 * 5/2014 Tiberghien ..... F16L 37/23 285/308

FOREIGN PATENT DOCUMENTS

WO 2005095198 A1 10/2005
WO 2008008877 A2 1/2008
WO 2008062212 A1 5/2008

* cited by examiner

APPARATUS AND METHOD FOR DISCONNECTING MALE AND FEMALE CONNECTORS

TECHNICAL FIELD OF THE INVENTION

The present invention relates to an apparatus and method for disconnecting male and female connectors such as those used in oil pipeline connections.

BACKGROUND TO THE INVENTION

Risers are used in subsea applications to provide a conduit for oil to be extracted from under the sea bed to floating production storage and offloading vessels (FPSO) or similar. The risers comprise a number of pipe sections that are joined together so that the oil can be conveyed safely to the surface of deep water. Due to movement of the vessel on the surface of the water, the risers are often subjected to external forces that cause the risers to flex and kink thereby resulting in damage to the risers. To reduce the likelihood of damage, bend stiffeners comprising a polyurethane conical shaped moulding are used to limit bending of the risers and protect the riser minimum bend radius.

Bend stiffeners are typically coupled to a FPSO vessel using a male and female connector. One of the connectors is usually attached to the vessel and the other connector is usually attached to the bend stiffener. The bend stiffener and corresponding connector are coupled to the connector on the vessel to lock the two together and hold the bend stiffener firmly in place. The riser can then be safely attached to the vessel through the bend stiffener so that oil can be extracted from the oil field in question.

When it is desired to separate the riser from the vessel, the male and female connectors may typically be urged apart using hydraulic rams, release or riser clamps. Such methods of separation can be prone to failure and require physical intervention by divers which is undesirable especially in potentially hazardous conditions.

It is an object of the present invention to provide a more convenient and reliable way to separate male and female connectors.

SUMMARY OF THE INVENTION

According to a first aspect of the present invention, there is provided a male connector intended to be inserted into a female connector, the male connector defining a conduit and comprising a locking means operable to engage the female connector to thereby lock the male connector relative to the female connector and a release means for unlocking the male connector to permit the male connector to be separated from the female connector, characterised in that the release means is accessible from within the conduit.

Advantageously, by making the release means accessible from inside the conduit it is possible to easily disengage the release means using a separate tool that can also be used to secure the male connector in the same operation so that the male connector can be safely and controllably removed from the female connector.

The locking means may have operative and inoperative positions in relation to the female connector and the release means may be operable between a permissive position in which the locking means can move between operative and inoperative positions and a preventative position in which the locking means is prevented from moving between operative and inoperative positions.

The release means may be operable from within the conduit by engaging the release means and urging the release means between permissive and preventative positions.

According to a second aspect of the present invention, there is provided a connector assembly comprising a male connector and a female connector that connectively define a conduit, a locking means arranged to lock the male connector relative to the female connector and a release means operable to unlock the male connector from the female connector, characterised in that the release means is accessible from within the conduit.

The locking means may be part of the male connector or the female connector. The release means may be part of the male connector or the female connector.

According to a third aspect of the present invention there is provided a release tool for use with a connector or connector assembly according to the first or second embodiments comprising a body arranged to be inserted into the conduit and an engagement means arranged to engage the release means to unlock the male connector relative to the female connector.

The engagement means of the release tool may be arranged, in use, to engage the male connector and retain the male connector relative to the release tool after the male connector is unlocked from the female connector.

The release tool may further comprise a limiter that limits the distance the release tool may extend into the conduit so that when the release tool extends the fully permitted distance into the conduit, the engagement means is positioned to engage the release means. The limiter may comprise a flange that is intended to abut a part of the male or female connector. The engagement means may comprise one or more balls for gripping the release means.

The release tool may further comprise one or more tapered grooves and the or each ball may be seated in a corresponding tapered groove and limited to movement along the groove by a sleeve that extends over the or each groove, the sleeve comprising an aperture for each ball so that the or each ball can extend at least partially through the sleeve. The or each groove may be shaped such that when the ball is in one position in the groove it extends at least partially through the aperture of the sleeve and when in another position the ball is substantially inside the sleeve. The sleeve may be biased toward a position in which the or each ball is urged at least partially through the or each aperture.

According to a fourth aspect of the present invention, there is provided a method of disconnecting a male connector from a female connector comprising the steps of:

providing a male connector defining a conduit and having a release means that when activated permits the male connector to be separated from the female connector, the release means being accessible from the conduit; and inserting a release tool into the conduit to activate the release means and permit the male connector to be separated from the female connector.

The method may further comprise the step of coupling the release tool with the male connector so that the release tool can be used to remove the male connector from the female connector.

DETAILED DESCRIPTION OF THE INVENTION

In order that the invention may be more clearly understood an embodiment thereof will now be described, by way of example only, with reference to the accompanying drawings, of which:

Figure 1:
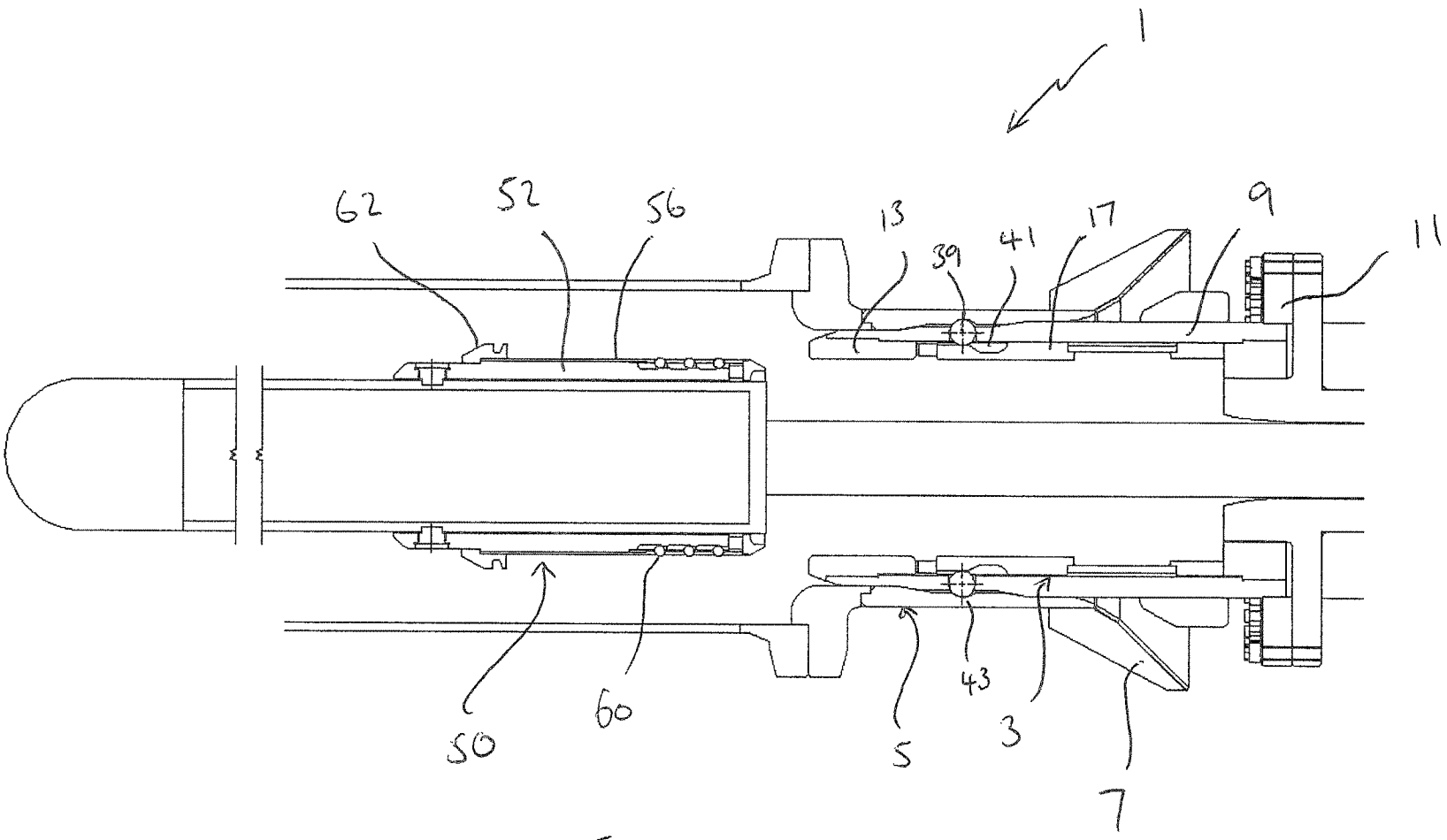
FIG. 1 shows cross section view of a male connector according to the present invention when locked relative to a female connector and waiting to receive a release tool.
Figure 2:
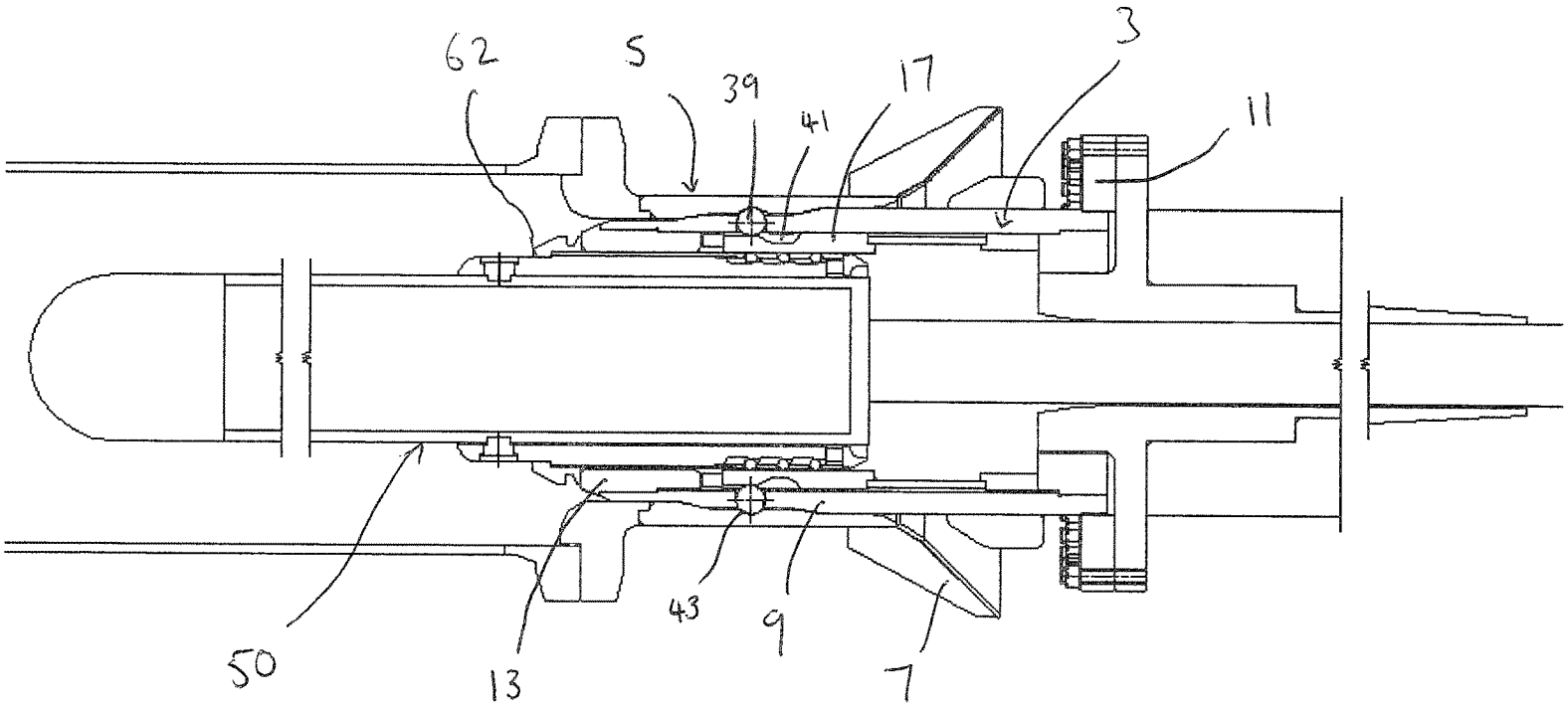
FIG. 2 shows a cross section view of the male and female connectors of FIG. 1 when the release tool is fully inserted into the male connector.
Figure 7A:
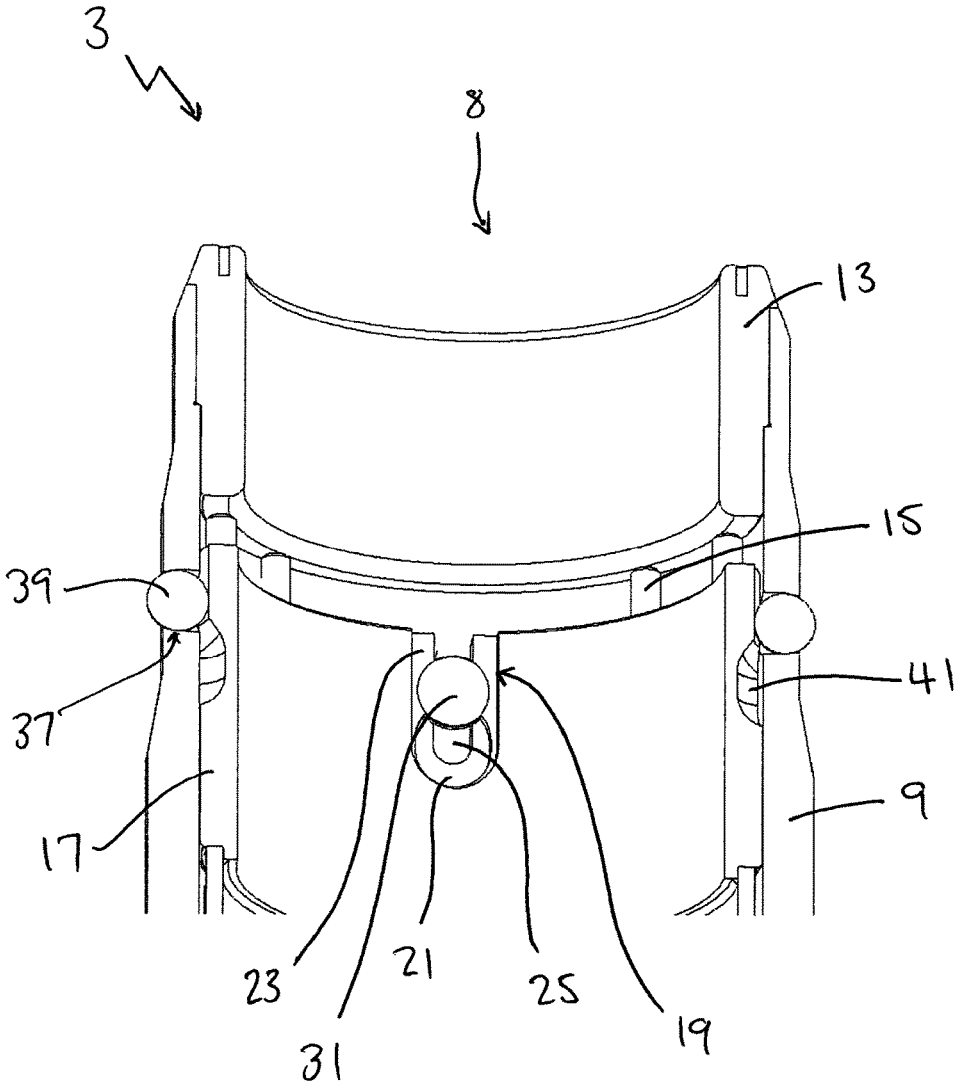
Figure 7B:
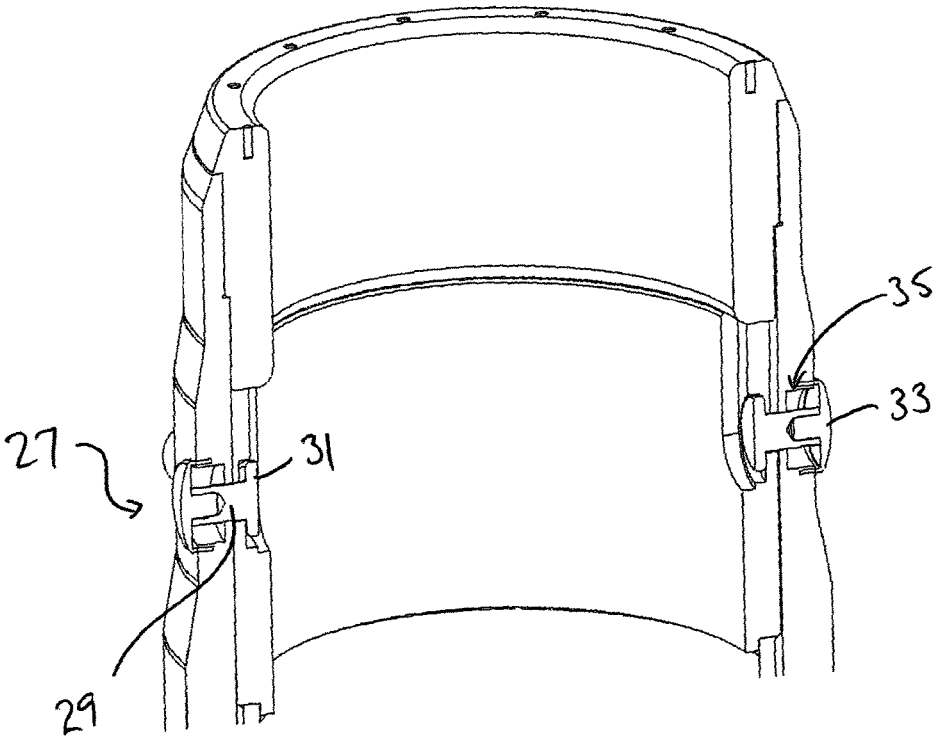
Figure 8:
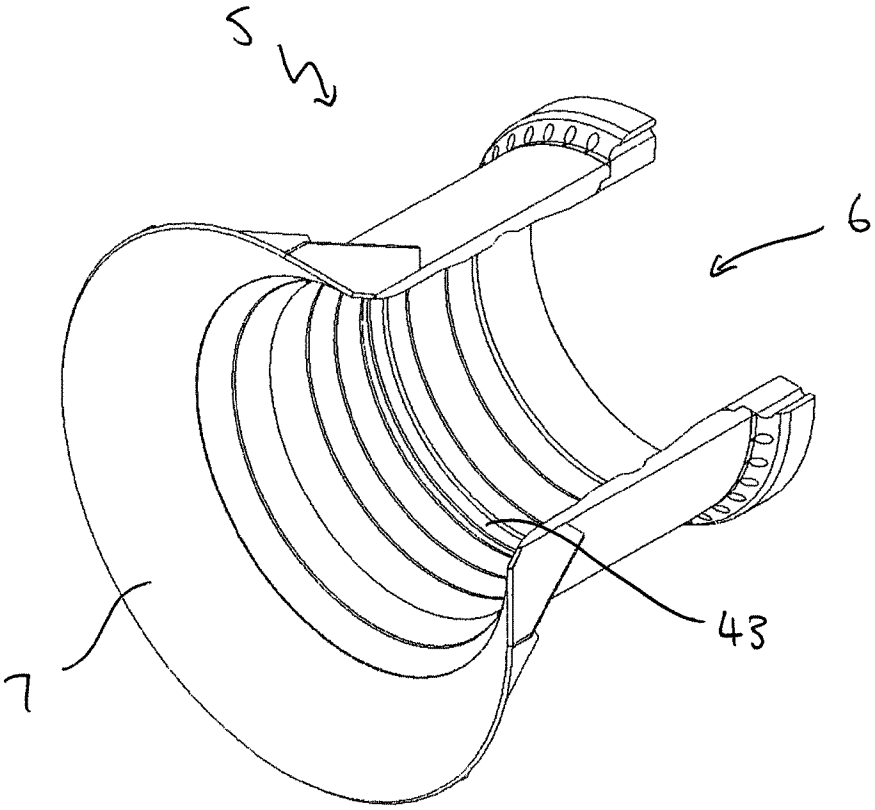
Figure 9:
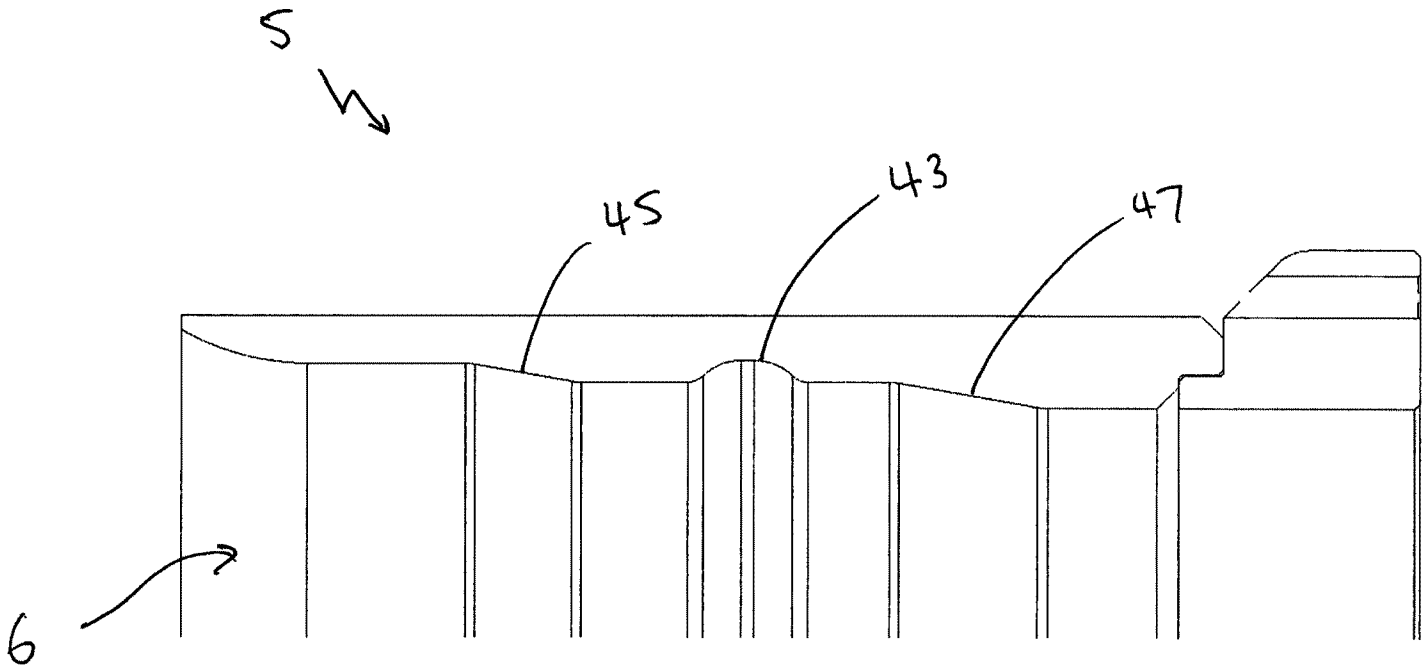

FIG. 7*a* shows a perspective cross section view of part of the male connector shown in FIG. 1 when the male connector is in a locked configuration;

FIG. 7*b* shows a perspective cross section view of part of the male connector shown in FIG. 1 when the male connector is in an unlocked configuration;

FIG. 8 shows a perspective view of the female connector shown in FIG. 1 with part cut away; and FIG. 9 shows a cross section view of a side of the female connector shown in FIG. 1.

Referring to the drawings there is shown a connection assembly 1 comprising a male connector 3 and a female connector 5. The female 5 connector defines a tapered bore 6 into which the male connector 3 may be inserted and further comprises a flared guide cone 7 at one opening to help guide the male connector 3 into the bore. The male connector 3 also defines a bore 8 so that when the male connector 3 and female connector 5 are coupled together, they both define a conduit through which a section of riser may extend.

The male connector 3 comprises a substantially cylindrical steel body 9 having a flange 11 at one end to facilitate attachment of the male connector 3 to a bend stiffener. A nose cone 13 is provided at the other end of the male connector 3 to protect the male connector 3 from damage upon insertion into the female connector 5 and also help to guide the male connector 3 into the female connector 5. A plurality of spring tubes 15 extend axially from an end of the nose cone 13 toward the flange end of the male connector. The spring tubes 15 serve as a support along which a substantially cylindrical hollow steel locking sleeve 17 may travel. A plurality of bores equal to the number of spring tubes 15 is formed in one end of the sleeve 17 to enable the sleeve to slide along the spring tubes axially with respect to the male body 9. A coil spring is retained within each bore and arranged to bias the sleeve 17 axially away from the nose cone 13.

A pair of diametrically opposed grooves 19 is formed in the sleeve 17. Each groove 19 comprises a substantially cylindrical depression 21 formed in the inner surface of the sleeve 17, a shallower channel 23 that extends from the cylindrical depression 21 along the inner surface of the sleeve 17 to the nose cone end of the sleeve 17 and a cut-out 25 that extends through the sleeve 17 from one side to the other and from the centre of the depression 21 along the centre of the channel 23 to the end of the sleeve 17.

Each groove 19 is arranged to interact with a corresponding latch pin 27 that extends through the sleeve 17 from one side to the other via the cut-out 25 and that is spring loaded to bias the latch pins 27 outwardly from the sleeve 17. The latch pin 27 comprises a substantially cylindrical body 29 having a substantially flat, circular foot 31 that extends radially from one end of the body and that has a larger diameter than the body 29. A cylindrical head section 33 is provided at the other end of the body 29. The head section 33 also has a larger diameter than the body 29 and is shaped to have a curved top to permit smooth contact with the walls of the female connector 5.

The depression 21 on the inside of the sleeve 17 is dimensioned to receive at least part of the foot 31 of the latch pin 27 so that when the foot 31 is received into the depression 21, the latch pin 27 and the sleeve 17 cannot move axially relative to one another. The channel 23 is dimensioned to have a width greater than the diameter of the platform 31 whilst the cut-out 25 is dimensioned to have a width greater than the body 29 of the latch 27. The cut-out 25 and channel 23 therefore permit the sleeve 17 to move along a controlled axial path along the body 9 of the male connector 3, guided by the latch pin 27.

Two diametrically opposed apertures 35 are formed through the body 9 of the male connector 3 to permit the latch pin 27 to extend through the body 9. Each aperture 35 comprises two distinct sections, a first section arranged on the sleeve side of the aperture which has a diameter smaller than the head 33 of the latch pin 27 but larger than the body 29 of the latch pin 27 and a second section extending toward the external side of the body 9 having a diameter larger than the head 33 of the latch pin 27. The interface between the first section and second section creates a stepped edge against which the latch pin head 33 may abut to limit the extent to which the latch pin 27 can be urged into the bore 8 of the male connector 3. The apertures 35 restrict movement of the latch pins 27 to radial movement only so that when the sleeve 17 moves axially along the body 9, the latch pins 27 do not move with the sleeve 17.

The body 9 of the male connector 3 further comprises a plurality of ball apertures 37 which extend through the body 9 and which are circumferentially spaced around the body 9 along the same plane as the latch pin apertures 35. Each ball aperture 37 is shaped to receive a spherical locking ball 39. The diameter of each ball aperture 37 reduces toward the external side of the body 9 to less than the diameter of a corresponding locking ball 39 so as to limit the extent to which a locking ball 39 can project from the aperture 37 and to prevent the locking balls 39 from falling out of the apertures 37. The locking balls 39 are retained in the apertures 37 on the other side of the body 9 by the sleeve 17 which always extends across the apertures 37.

Figure 4:
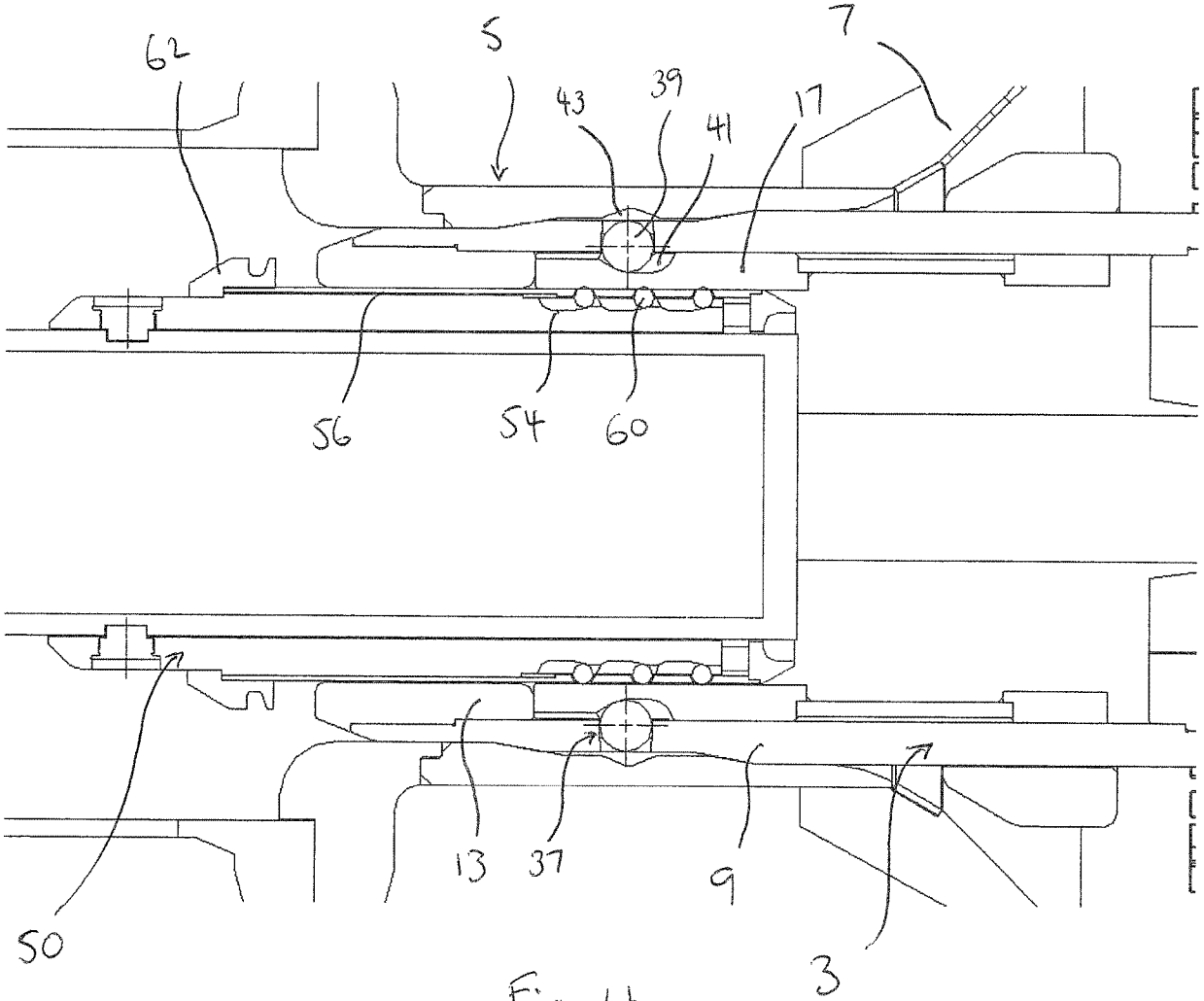
FIG. 4 shows an enlarged view of the male and female connectors shown in FIG. 1 when the release tool is pulled out from the male connector.

The body facing side of the sleeve 17 comprises a plurality of substantially hemi-spherical grooves 41 equivalent in number to the number of ball apertures 37 and hence balls 39 that extend through the body 9. The ball grooves 41 are arranged such that, when the sleeve 17 is positioned toward the nose cone 13, the ball grooves 41 are aligned with the ball apertures 37 so that the locking balls 39 can move into the ball grooves 41. Thus, the locking balls 39 have two operative positions, a first position in which the locking balls 39 are urged out from apertures 37 toward the external side of the body 9 by the outer surface of the sleeve (as shown in FIG. 7*a*) and a second position in which the locking balls 39 can move into the ball grooves 41 (as shown in FIG. 4) from the ball apertures 37.

The female connector 5 further comprises a circumferential groove 43 that extends around the internal surface of the connector 5. The groove or ring 43 is positioned such that when the male connector 3 is fully inserted into the female connector 5, the ring 43 lies adjacent the ball apertures 37 of the male connector 3. In this position, the balls 39 may be urged outwardly from the apertures 37 into the ring 43 to help lock the male connector 3 relative to the female connector 5. A pair of tapered edges 45, 47 is positioned either side of the ring 43 to provide abutments for corresponding tapered edges formed on the body 9 of the male connector. The corresponding tapered edges help to correctly position the ring 43 relative to the ball apertures 37 when the tapered edges of the respective connectors 3, 5 are brought into contact.

A connector release tool 50 is also shown. The release tool 50 is dimensioned to fit within the bore 8 of the male connector 3 and is attachable to a work wire that facilitates insertion of the riser and release tool through the male connector 3. The release tool 50 comprises a substantially cylindrical body 52 having a plurality of tapered grooves 54 formed at spaced apart intervals around the outer surface of the extreme end of the body 52. A spring loaded ball cage sleeve 56 is arranged around the outside of the body 52 and biased in an axial direction toward the end of the body 52 at which the tapered grooves 54 are formed. The ball cage sleeve 56 is movable between first and second positions along the body 52. A plurality of substantially circular apertures 58 equivalent to the number of tapered grooves 54 are formed through the ball cage 56 and arranged to lie adjacent the grooves 54 when the ball cage is positioned around the body in both the first and second positions and at every position there between.

Figure 3:
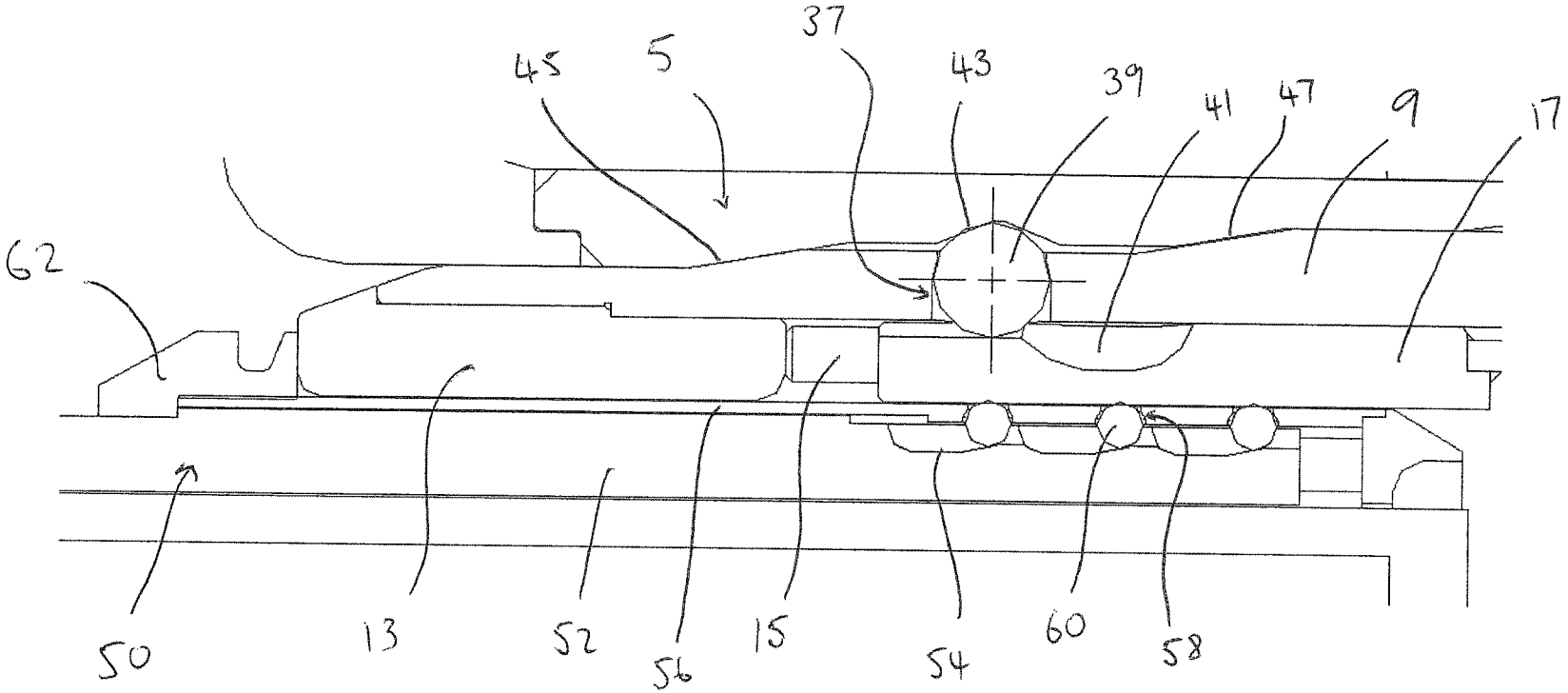
FIG. 3 shows an enlarged cross section view of a part of the male and female connectors and the release tool shown in FIG. 2.

A gripping ball 60 is arranged in each groove 54 between the body 52 and the ball cage aperture 58 thereby restricting movement of the gripping balls 60 to the tapered grooves 54. The tapering of the grooves 54 is such that when the ball cage sleeve 56 is in the biased, locked position as shown in FIG. 3, the gripping balls are urged up the tapered grooves by the ball cage apertures 58 so that the gripping balls 60 project from the ball cage apertures 58. Each ball cage aperture 58 is constricted toward the outside of the sleeve 56 so as to prevent the gripping balls from falling out from the grooves 54. When the sleeve 56 is pulled against the action of the springs and moved back from the end of the tool 50, the gripping balls are urged toward the deeper end of the grooves 54 so that the balls no longer project from the outer surface of the sleeve 56.

A ball cage flange 62 or stop is positioned around the outside of the body of the tool 50 between the ball cage sleeve 56 and the point of attachment to the work wire. The ball cage flange 62 is arranged to abut the nose cone 13 of the male connector upon insertion of the tool 50 into the male connector 3 and positioned such that when the ball cage flange 62 abuts the nose cone 13, the tapered grooves and gripping balls lie adjacent the release sleeve 17 of the male connector 3.

In use, a bend stiffener is fixed to the flange 11 of the male connector 3 and the corresponding female connector 5 is fixed to an oil drilling platform or vessel. A work wire is attached to the male connector 3 to enable the male connector 3 to be pulled inside the female connector 5. Before insertion of the male connector 3 into the female connector 5, the locking sleeve 17 is urged against the spring loading toward the nose cone 13 until the latch pins 27 are centred over the corresponding depression 21. The spring loading on the latch pins 27 cause them to move radially outwardly until the latch pin feet 31 sit within the depressions, thereby fixing the sleeve 17 relative to the male body 9. In this position, the latch pin heads 33 project outside of the body 9 and the locking balls 39 are free to sit within the ball grooves 41.

Once the sleeve 17 has been loaded, the male connector 3 is pulled inside the female connector 5 by the work wire. As insertion of the male connector 3 progresses, the internal tapered sides of the female connector 5 begin to squeeze the latch pins 27 in toward the bore of the male connector 3 until the latch pin feet 31 are urged out from the depressions 21. At this point, the spring loading on the sleeve 17 urges the sleeve 17 away from the nose cone 13. Movement of the sleeve 17 drives the locking balls 39 out from the ball grooves 41 and further out from the ball apertures 37 so that the locking balls 39 project from the male body 9. The tapering of the female connector 5 is such that the latch pins 27 and, hence, sleeve 17 are activated when the balls 39 are positioned adjacent the retaining ring 43 on the inner wall of the female connector 5. The balls 39 may therefore project from the body 9 into the ring 43 and be held in place by the forces exerted on the locking balls 39 by the outer side of the sleeve 17 and the walls of the retaining ring 43. When in this position, the male connector 3 is locked relative to the female connector 5 as shown clearly in FIG. 3.

When it is desired to unlock the male connector 3 from the female connector 5, the release tool 50 is attached to the work wire and any fitting attached to the riser and inserted into the bore 8 of the male connector 3. As the release tool 50 is urged inside the male connector, the ball cage sleeve 56 is urged back toward the ball cage flange 62 by the walls of the nose cone 13. Movement of the ball cage sleeve 56 toward the flange 62 urges the gripping balls 60 back down the tapered sides of the gripping ball grooves 54 until the balls lie within the walls of the ball cage sleeve 56. Thus, the release tool 50 can be inserted into the male connector 3 without interference from the gripping balls 60.

The release tool 50 is further inserted into the male connector 3 until the stop 62 abuts the face of the male connector nose cone 13. A reduction in load on the work wire is then seen which indicates the release tool 50 is fully inserted inside the male connector 3 and the tapered grooves 54 and locking balls 60 are lined up with the locking sleeve 17. In this position, the nose cone 13 no longer acts on the ball cage sleeve 56 and the spring loading urges the ball cage sleeve 56 back toward the end of the release tool 50. Movement of the ball cage sleeve 56 toward the end of the release tool 50 urges the gripping balls 60 up the tapered grooves 54 until the gripping balls 60 project from the sleeve 56 and engage the internal wall of the locking sleeve 17. Once the gripping balls 60 engage the locking sleeve 17, the release tool 50 is pulled back out from the male connector 3. The friction between the locking sleeve 17 and gripping balls 60 cause the gripping balls 60 to be urged further toward the end of the release tool 50 thereby increasing the force with which the gripping balls 60 engage the locking sleeve 17. The release tool 50 therefore pulls the locking sleeve 17 toward the nose cone 13 against the spring loading of the locking sleeve 17 until the ball grooves 41 are adjacent the locking balls 39 and the latch pin feet 31 are centred over the depressions 21. In this position, the locking balls 39 are free to move into the ball grooves 41 and the male connector 3 is therefore unlocked from the female connector.

Figure 5:
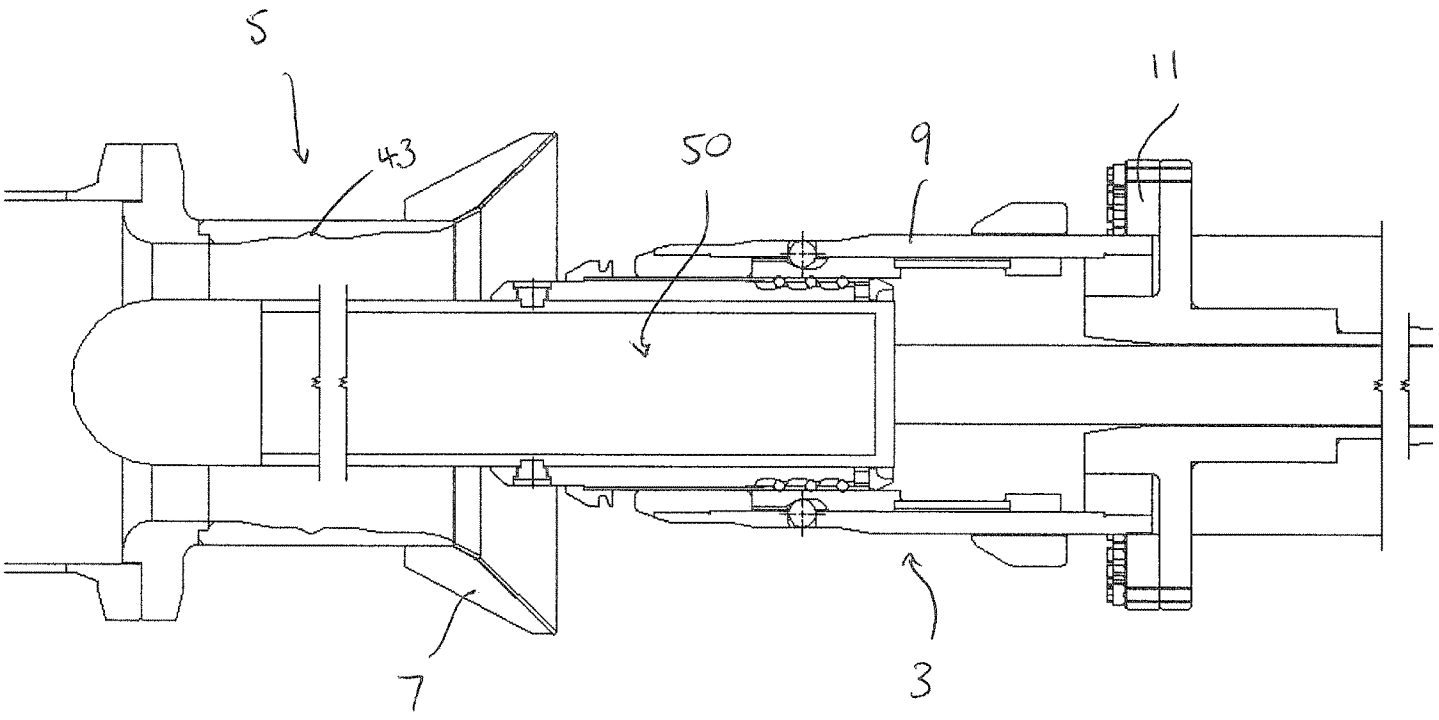
FIG. 5 shows the male connector and release tool of FIG. 1 when connected being removed from the female connector.
Figure 6:
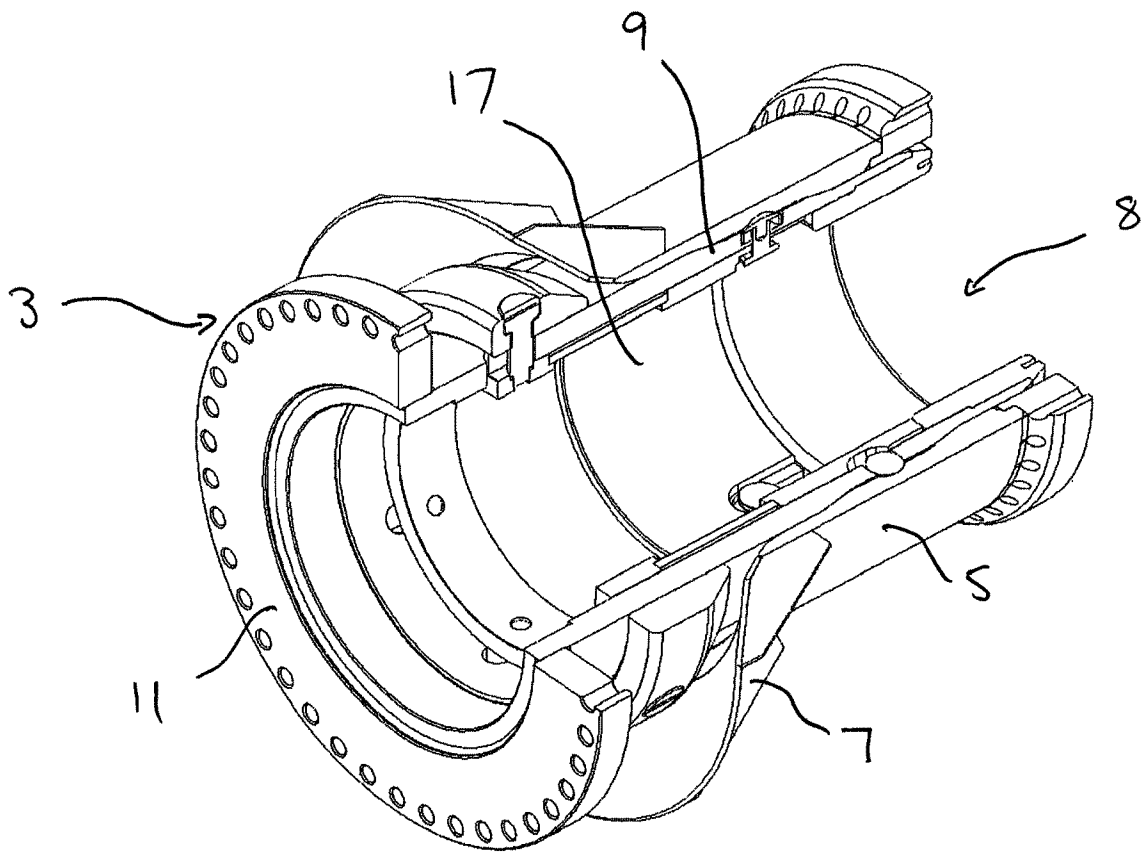
FIG. 6 shows a perspective view of the male inserted in the female connector shown in FIG. 1 with part cut away.

Since the male and female connector assembly is intended in use to be substantially vertically oriented, the male connector and attached bend stiffener are pulled down against the action of the gripping balls 60 by gravity. Consequently, the release tool 50 and male connector 3 remain coupled together even after the male connector 3 is unlatched from the female connector 5. The coupled release tool 50 and male connector 3 are then lowered down out from the female connector 5 (as shown in FIG. 5) and recovered. As the male connector is removed from the female connector, the latch pins no longer abut the inner surface of the female connector and are urged radially outwardly by their spring loading until the feet 31 are seated within the depressions 21.

The above embodiment is described by way of example only. Many variations are possible without departing from the scope of the invention as defined in the appended claims.

The invention claimed is:

1. A release tool for use with a male connector intended to be inserted into a female connector, the male connector defining a conduit and comprising a lock operable to engage the female connector to thereby lock the male connector relative to the female connector and a release for unlocking the male connector to permit the male connector to be separated from the female connector, characterised in that the release is activated by the release tool from within the conduit of the male connector;

wherein the release tool comprises a body arranged to be inserted into the conduit of the male connector, and the release tool comprises an engagement means arranged to engage the release to unlock the male connector relative to the female connector, and wherein the engagement means comprises one or more balls or rollers for gripping the release.

2. A release tool as claimed in claim 1, wherein the engagement means is arranged, in use, to engage the male connector and retain the male connector relative to the release tool after the male connector is unlocked from the female connector.

3. A release tool as claimed in claim 1, further comprising a limiter that limits the distance the release tool may extend into the conduit so that when the release tool extends the fully permitted distance into the conduit, the engagement means is positioned to engage the release.

4. A release tool as claimed in claim 3, wherein the limiter comprises a stop that is intended to abut a part of the male or female connector.

5. A release tool as claimed in claim 4, wherein the stop comprises a flange.

6. A release tool as claimed in claim 1, wherein the one or more balls or rollers is/are urgable into contact with the release and arrangable to wedge or bite into the release.

7. A release tool as claimed in claim 1, further comprising one or more tapered grooves and wherein each of the one or more balls or rollers is seated in a corresponding tapered groove and limited to movement along the groove by a sleeve that extends over the groove, the sleeve comprising an aperture for each ball or roller so that each ball or roller can extend at least partially through the sleeve.

8. A release tool as claimed in claim 7, wherein each groove is shaped such that when the ball or roller is in one position in the groove it extends at least partially through the aperture of the sleeve and when in another position the ball or roller is substantially inside the sleeve.

9. A release tool as claimed in claim 8, wherein the sleeve is biased toward a position in which each ball or roller is urged at least partially through each aperture.

10. A method of disconnecting a male connector from a female connector comprising:

providing the male connector defining a conduit and having a release that when activated permits the male connector to be separated from the female connector, the release being accessible from the conduit; and inserting a release tool into the conduit to activate the release and permit the male connector to be separated from the female connector, wherein the male connector comprises a lock operable to engage the female connector to thereby lock the male connector relative to the female connector and the release for unlocking the male connector to permit the male connector to be separated from the female connector, wherein the release tool comprises a body arranged to be inserted into the conduit and an engagement means arranged to engage the release to unlock the male connector relative to the female connector, wherein the engagement means comprises one or more balls or rollers for gripping the release.

11. A method as claimed in claim 10, further comprising coupling the release tool with the male connector so that the release tool can be used to remove the male connector from the female connector.

12. A release tool for use with a connector assembly comprising a male connector and a female connector that connectively define a conduit, a lock arranged to lock the male connector relative to the female connector and a release operable to unlock the male connector from the female connector, characterised in that the release is accessible from within the conduit; wherein the release tool comprises a body arranged to be inserted into the conduit and an engagement means arranged to engage the release to unlock the male connector relative to the female connector;

wherein the engagement means comprises one or more balls or rollers for gripping the release.

13. A release tool as claimed in claim 12, wherein the engagement means is arranged, in use, to engage the male connector and retain the male connector relative to the release tool after the male connector is unlocked from the female connector.

14. A release tool as claimed in claim 12, further comprising a limiter that limits the distance the release tool may extend into the conduit so that when the release tool extends the fully permitted distance into the conduit, the engagement means is positioned to engage the release.

15. A release tool as claimed in claim 14, wherein the limiter comprises a stop that is intended to abut a part of the male or female connector.

16. A release tool as claimed in claim 15, wherein the stop comprises a flange.

17. A release tool as claimed in claim 12, wherein the one or more balls or rollers is/are urgable into contact with the release and arrangable to wedge or bite into the release.

18. A release tool as claimed in claim 12, further comprising one or more tapered grooves and wherein each of the one or more balls or rollers is seated in a corresponding tapered groove and limited to movement along the groove by a sleeve that extends over the groove, the sleeve comprising an aperture for each ball or roller so that the ball or roller can extend at least partially through the sleeve.

19. A release tool as claimed in claim 18, wherein each groove is shaped such that when the ball or roller is in one position in the groove it extends at least partially through the aperture of the sleeve and when in another position the ball or roller is substantially inside the sleeve.

20. A release tool as claimed in claim 19, wherein the sleeve is biased toward a position in which each ball or roller is urged at least partially through each aperture.

21. A system comprising a female connector, a male connector intended to be inserted into the female connector and a release tool for use with the male connector; the male connector defining a conduit and comprising a lock operable to engage the female connector to thereby lock the male connector relative to the female connector and a release for unlocking the male connector to permit the male connector to be separated from the female connector, wherein the release is activated by the release tool from within the conduit of the male connector;

wherein the release tool comprises a body arranged to be inserted into the conduit of the male connector, and the release tool comprises an engagement means arranged to engage the release to unlock the male connector relative to the female connector, and wherein the engagement means comprises one or more balls or rollers arranged to grip the release and urge it between permissive and preventative positions;

wherein when the release is in the permissive position, the lock can move between operative and inoperative positions, and in the preventative position the lock is prevented from moving between operative and inoperative positions.

22. A system comprising a connector assembly and a release tool for use with the connector assembly; the connector assembly comprising a male connector and a female connector that connectively define a conduit, a lock arranged to lock the male connector relative to the female connector and a release operable to unlock the male connector from the female connector, wherein the release is accessible from within the conduit; wherein the release tool comprises a body arranged to be inserted into the conduit and an engagement means arranged to engage the release to unlock the male connector relative to the female connector;

wherein the engagement means comprises one or more balls or rollers arranged to grip the release and urge it between permissive and preventative positions;

wherein when the release is in the permissive position, the lock can move between operative and inoperative positions, and in the preventative position the lock is prevented from moving between operative and inoperative positions.

* * * * *